US011313299B2

(12) United States Patent
Marconato et al.

(10) Patent No.: US 11,313,299 B2
(45) Date of Patent: Apr. 26, 2022

(54) PROCESSING OF SIGNALS FROM A CRANKSHAFT SENSOR

(71) Applicant: VITESCO TECHNOLOGIES GMBH, Hanover (DE)

(72) Inventors: Benjamin Marconato, Toulouse (FR); Stéphane Eloy, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/291,750

(22) PCT Filed: Nov. 8, 2019

(86) PCT No.: PCT/EP2019/080659

§ 371 (c)(1),
(2) Date: May 6, 2021

(87) PCT Pub. No.: WO2020/094835

PCT Pub. Date: May 14, 2020

(65) Prior Publication Data

US 2022/0025827 A1 Jan. 27, 2022

(30) Foreign Application Priority Data

Nov. 8, 2018 (FR) ..... 1860272

(51) Int. Cl.
*F02D 41/26* (2006.01)
*F02D 41/00* (2006.01)

(52) U.S. Cl.
CPC .... *F02D 41/009* (2013.01); *F02D 2041/0092* (2013.01); *F02D 2250/06* (2013.01)

(58) Field of Classification Search
CPC ..... F02D 41/26; F02D 41/009; F02D 2041/0092; F02D 2250/06
USPC ..... 123/436, 481; 701/110, 112, 113
See application file for complete search history.

(56) References Cited

U.S. PATENT DOCUMENTS

| | | | |
|---|---|---|---|
| 9,790,870 | B2 | 10/2017 | Hou |
| 9,915,586 | B2 | 3/2018 | Hou |
| 2013/0245914 | A1 | 9/2013 | Shimizu |
| 2018/0031594 | A1 | 2/2018 | Joseph et al. |

FOREIGN PATENT DOCUMENTS

| | | |
|---|---|---|
| WO | 2014/082730 A1 | 6/2014 |
| WO | 2014/082731 | 6/2014 |
| WO | 2016/134841 | 9/2016 |

OTHER PUBLICATIONS

International Search Report and Written Opinion of the ISA for PCT/EP2019/080659, dated Feb. 5, 2020, 11 pages.

*Primary Examiner* — Hai H Huynh
(74) *Attorney, Agent, or Firm* — Nixon & Vanderhye

(57) ABSTRACT

Disclosed is a method for processing signals from a crankshaft sensor including the following steps: detection of a stopping of the engine; simulation and transmission of a backwards-running square waveform; and simulation and transmission of a forwards-running square waveform. Also disclosed is a processing module configured to implement such a method.

20 Claims, 5 Drawing Sheets

PROCESSING OF SIGNALS FROM A CRANKSHAFT SENSOR

This application is the U.S. national phase of International Application No. PCT/EP2019/080659 filed 8 Nov. 2019, which designated the U.S. and claims priority to FR Patent Application No. 1860272 filed 8 Nov. 2018, the entire contents of each of which are hereby incorporated by reference.

BACKGROUND OF THE INVENTION

Field of the Invention

The present invention generally relates to the field of motor vehicle electronics. It is aimed in particular at a method and a device for processing signals from a crankshaft sensor.

Description of the Related Art

It is known practice to use a crankshaft sensor to determine the angular position and the speed of a combustion engine with precision, notably in order to be able to perform engine control and to determine, precisely, for example, the moment at which to inject and/or to ignite.

As illustrated in FIG. 1, such a crankshaft sensor 1 conventionally comprises a crankshaft wheel 2 that rotates as one with the crankshaft. This crankshaft wheel 2 has a particular known profile, such as a set of teeth, at its periphery. The crankshaft sensor 1 also comprises a sensitive element 3, which is fixed relative to the engine block, capable of detecting the particular profile and disposed for this purpose facing the periphery of the crankshaft wheel 2. According to one embodiment, the crankshaft wheel 2 is metallic and the sensitive element 3 is able to detect metal, such as a Hall effect sensor. The profile of the crankshaft wheel 2 typically comprises a regular set of teeth, comprising a known number of teeth and at least one index 4 that makes it possible to identify a position on the revolution, such as one or more missing teeth. According to one possible embodiment, a crankshaft wheel 2 comprises 60 teeth, 2 of which are absent so as to form an index 4. Alternatively, according to another possible embodiment, a crankshaft wheel 2 comprises 36 teeth, 1 of which is absent so as to form an index 4.

Such a crankshaft sensor 1 supplies a signal comprising square waveforms. A square waveform comprises at least one edge corresponding to one of the tooth edges of the crankshaft wheel 2. The detection of the index 4 means it is possible to provide an absolute angular position reference. Relative to this reference, it is possible to count the square waveforms and determine which tooth is detected. Counting the teeth/square waveforms means that, by successive increments, it is possible to maintain awareness of the absolute angular position of the crankshaft wheel 2 and therefore of the crankshaft and of the engine. Because the geometry of the crankshaft wheel is known, the angular increment corresponding to one tooth is known. Thus, for a 36-tooth wheel, each tooth detected corresponds to an angular increment of 10°. From the successive items of position information it is possible, by measuring the time elapsed between two successive wave edges, to determine an instantaneous or mean angular speed of the engine.

In the interval between two teeth, the position is interpolated, for example by using an estimate of the angular speed. The estimated angular position obtained by such an extrapolation is corrected by a realignment on receipt of a new square waveform, which therefore supplies an exact position. This is illustrated in FIG. 2. The signal CRK is the signal from the crankshaft sensor 1. It comprises a square waveform associated with each tooth #1, #2, etc. In this instance, the square waveforms are negative. The falling edge of a square waveform corresponds to the rising edge of a tooth. At the falling edge of the square waveform #1, the angular position is known with precision. Between the tooth #1 and the tooth #2, the angular position is estimated by linear extrapolation based on the angular speed. This estimate is indicated as a solid line. By contrast, the true position is indicated as a dotted line. It may be seen that the estimate is pessimistic. On receipt of the next falling wave edge, corresponding to tooth #2, the angular position is once again known with precision. That means that the estimated angular position can be realigned by immediately correcting it, in this instance by applying a readjustment of 1.4°. The same is true between teeth #2 and #3, and, respectively, teeth #3 and #4, although with a readjustment limited to 0.7° and, respectively, 0.4°. Between teeth #4 and #5 the estimate is closer to the correct value and no readjustment is needed.

In the event of an optimistic estimate, such as, for example, can be seen in FIG. 4, between teeth #2 and #3, the estimated position reaches the angular position corresponding to the next tooth more rapidly than the true angular position. The estimated position has to be confined to not exceeding this position as long as the square waveform corresponding to that tooth has not been received. On receipt of said square waveform, the angular position is confirmed.

More often than not, an engine, and with it its crankshaft, rotates in forwards running. However, it can happen that this direction is reversed at least temporarily. This is the case if the engine "hiccups" or when an engine is close to stopping because of the strong back thrust of the pistons. Certain types of crankshaft sensor make it possible to determine the direction of passage of a tooth.

In one embodiment, the signal from the crankshaft sensor 1 has a square waveform, of which one of the wave edges (the rising or the falling edge) occurs at the exact position of the corresponding edge of the tooth, and the other wave edge is offset from the previous one by a duration that differs according to the direction of rotation. Thus, for example, a crankshaft sensor produces a square waveform of length 45 μs in forwards running and of length 90 μs when running backwards.

The crankshaft sensor 1 itself does not have the capacity to observe the direction of rotation; said direction of rotation can be determined by processing the signal from the crankshaft sensor 1.

However, in both instances: sensor indicating the direction of rotation or determining it by signal processing, the direction information is available only with a certain delay, at least equal to the length of the square waveform.

From the signal from the crankshaft sensor 1, combined with the information regarding the direction of rotation for each tooth, it is possible to maintain an absolute angular position. The angular position is incremented by an angular increment (the angular duration of a tooth) for each square waveform in forwards running and is decremented by an angular increment for each square waveform in backwards running.

A dedicated processing device 5 is conventionally tasked with performing this processing so as to maintain an absolute angular position and, where appropriate, an angular speed. This processing device 5, referred to as a Generic Timer Module (GTM), already exists. It is assumed that, for economic reasons at least, it is not going to be able to be developed further in the immediate future.

A problem may arise, when restarting the engine, when the last square waveform before the engine stopped was a backwards-running square waveform. This is illustrated in FIGS. 3 and 4 on a diagram that shows the true angular position, as a dotted line, compared with the angular position as seen/estimated by the processing device 5, as a solid line, against the signal CRK from the crankshaft sensor 1. FIGS. 3 and 4 are equivalent. In FIG. 3, the angular position is shown in absolute, whereas in FIG. 4 it is shown offset. In FIG. 3, the stopping of the engine is indicated in the middle of the graph by the word "stop". In FIG. 4, the stopping of the engine is shown as a double oblique stroke; the left-hand part of FIG. 3, before the stopping of the engine, is not reproduced in FIG. 4.

From left to right, the engine is turning and successively occupies the angular position (corresponding to the tooth) #0, then #1, as indicated by a forwards-running (FW) square waveform #0 and a forwards-running square waveform #1. Between the teeth, since the angular position has been known exactly for several teeth, the angular speed is correct and allows a correct extrapolation of the angular position: the two curves are coincident.

On its way toward position #2, the engine stops and changes direction. It sees a tooth, which is in fact tooth #1 seen again while running backwards (BW). The engine then stops between the positions #0 and #1.

When the next square waveform is received, which corresponds to tooth #1, but in backwards running (BW), the processing performed on the falling edge of the square waveform thinks that it is seeing square waveform #2 in forwards running and increments the position accordingly. The angular position as seen by the processing device is first of all identified as #2, because the processing device assumes forwards running (FW). Following receipt of the information indicating backwards running (BW), the rising edge and the length of the square waveform indicating that this is a backwards-running square waveform, it becomes apparent that the tooth observed was tooth #1 and not tooth #2. The angular position as seen by the processing device 5 is therefore readjusted to account for the fact that the position is tooth #1. The angular position is corrected and identified #1. Before complete stopping, an extrapolation leads to an identification #0.

A stopping of the engine is typically detected by a sufficiently long lapse of time, for example 250 ms, during which no square waveform is produced/received.

At the time of the following restart, the processing device 5 receives a first forwards-running square waveform #1. Because the last square waveform before the stopping of the engine was in backwards running, the processing device assumes, on receiving the falling wave edge, that the new square waveform is likewise also in backwards running. It therefore begins to decrement the angular position. On receipt of the rising wave edge, which is of short duration, it finds that the square waveform is, rather, in forwards running, and that it therefore corresponds to tooth #1. It then corrects the angular position which immediately updates to position #1. The angular position is then interpolated.

Now, in the absence of a history of square waveforms recently received, it is not possible to determine the speed with precision. Thus, for example, the speed considered is a default value. In this instance, this is a very pessimistic estimate and the estimated position is far from the position #2 when the next wave edge #2 is received. Following a stop, the gradient used for the extrapolation is deliberately shallow. On receipt of the next square waveform, correctly considered to correspond to tooth #2, the estimated angular position is corrected and immediately updated to position #2.

While awaiting a subsequent square waveform, the position is once again estimated. The extrapolation here is excessively optimistic, with too steep a gradient/too high a speed. This is due to a speed that is still poorly known and estimated at too high a value by a calculation based on the last two teeth #1 and #2 seen and the time spent waiting for the wave edge #2. The extrapolation is optimistic because of the steep gradient observed at the previous square waveform. On receipt of the next square waveform, the position is confirmed at tooth #3.

Receipt of a third square waveform #3, in so far as it provides knowledge of the temporal and angular characteristics of a third tooth #3, allows a more precise angular speed to be calculated. This results, between teeth #3 and #4, in a better extrapolation: the estimated position is closer to the true position with a readjustment, on receipt of the square waveform #4, limited to 0.4°. The receipt of a fourth square waveform allows an even more precise angular speed to be calculated. This results, between teeth #4 and #5, in an improved extrapolation: the estimated angular position is substantially identical to the true angular position.

After 3 teeth #1, #2, #3, the speed is estimated with sufficient precision and the extrapolation based on this speed becomes more accurate, as can be seen after point #3 where the estimated angular position is close to the true angular position.

Also, in the special case of an engine stopping with the last square waveform having been in backwards running, there is enough imprecision in the angular position that engine control operations: injection and/or ignition, cannot be performed in the three square waveforms following a stopping of the engine. In order to take account of this special case, there is, as a precautionary measure, even in the case where the last square waveform was in forwards running, systematically a wait of 3 square waveforms after a start before the possibility of injection and/or ignition is considered.

A wait of 3 square waveforms corresponds to several tens of degrees engine (20 to 30° for a 36-tooth crankshaft wheel 2), with a duration substantially equivalent to several tens of milliseconds (20 to 30 ms). This angle/wait quickly lengthens when close to the index 4 (40 to 50° for a 36-tooth crankshaft wheel) or to top dead center. In the case of top dead center, it is necessary to wait for the next cylinder before performing an injection and/or ignition action, with an attendant factor of 10. In this way, the angle/wait can reach as much as 200°/200 ms. Such a wait is detrimental insofar as it is perceived in a negative light by the driver. Driving pleasure is impaired. This is more especially true in a "change of mind" scenario in which the driver stops the vehicle, something which, with a start/stop system, causes the engine to stop, and then immediately has a change of mind and seeks to restart, for example by depressing the clutch.

So, in order to improve the experience of the driver, it is appropriate to find an alternative solution. This solution is also constrained by the fact that it is not possible/desirable to modify the processing device 5.

SUMMARY OF THE INVENTION

The objective of the invention is to eliminate the 3 square waveform wait so as to allow the engine to be restarted more rapidly and thus make the engine more responsive.

This objective is achieved by virtue of a method whereby a processing module processes signals from a crankshaft sensor in order to determine the position of an internal combustion engine upon a starting of said engine following a stopping thereof, said crankshaft sensor comprising a crankshaft wheel comprising a determined number of teeth and at least one index allowing a position in the revolution to be identified, said sensor being able, in combination with a processing device for processing said signals, to determine the position of the crankshaft and its direction of rotation, from said signals comprising forwards-running and backwards-running square waveforms, characterized in that it comprises the following steps:

- detection of a stopping of said internal combustion engine, and, if the last square waveform received by the processing device before the stopping of the engine corresponds to the engine rotating backwards:

- suspension of the transmission to the processing device of an "engine stopped" status signal, and then
- simulation by the processing module and transmission to the processing device of a backwards-running square waveform,
- simulation by the processing module and transmission to the processing device of a forwards-running square waveform, leading to a detection by the processing device that the crankshaft is running forwards, and,
- following the transmission of the two simulated square waveforms to the processing device, the lifting of said suspension and the transmission of the "engine stopped" status signal to the processing device.

According to another feature, the transmission of the backwards-running square waveform immediately follows the detection that the engine has stopped.

According to another feature, the transmission of the forwards-running square waveform is delayed after transmission of the backwards-running square waveform by enough of a delay to render a noise filtering strategy inoperative, preferably by a delay equal to 1 ms.

According to another feature, a calculation of the engine speed ignores the simulated backwards-running square waveform.

According to another feature, a calculation of the engine speed ignores the simulated backwards-running square waveform and the simulated forwards-running square waveform.

According to another feature, the speed is considered to be equal to a first constant mean value, preferably equal to 60 rpm, when only a single square waveform has been received, and/or the speed is calculated on the basis of the time between two square waveforms, or is considered to be equal to a second constant mean value, preferably equal to 90 rpm, when only two square waveforms have been received.

The invention also relates to a processing module for processing signals from a crankshaft sensor and configured to implement such a method.

BRIEF DESCRIPTION OF THE DRAWINGS

Further features and innovative advantages of the invention will become apparent from reading the following description, which is provided by way of non-limiting example, with reference to the accompanying drawings, in which.

DESCRIPTION OF THE PREFERRED EMBODIMENTS

For greater clarity, identical or similar elements have been designated by identical reference signs throughout the figures.

In order to address the aforementioned problem, the invention comprises a processing module 6 capable of processing the signals and information from a crankshaft sensor 1.

Figure 7:
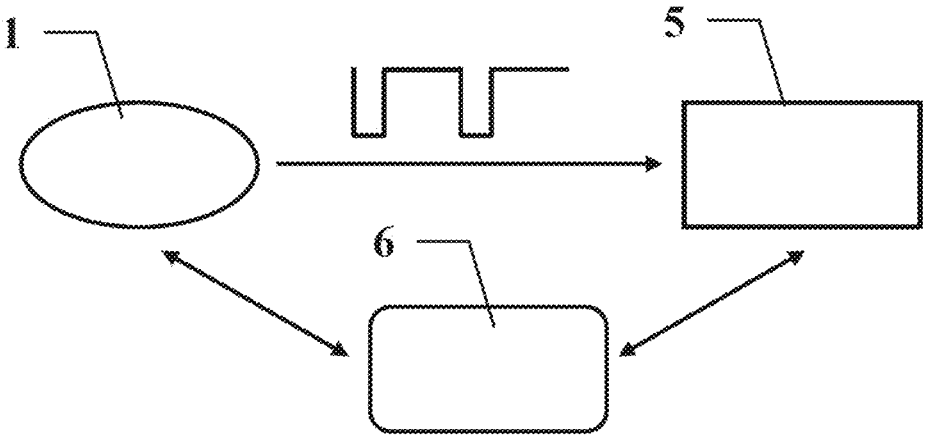
FIG. 7 illustrates the situation of the invention

As illustrated in FIG. 7, a crankshaft sensor 1 transmits a signal containing square waveforms to a processing device 5 which processes it in order to maintain an absolute angular position of the crankshaft and therefore of the engine. The processing module 6 according to the invention is interposed between the crankshaft sensor 1 and the processing device 5.

The aforementioned problem is greatly exacerbated by the fact that the last square waveform seen before the stopping of the engine is a backwards-running square waveform. It then follows, as described previously, that an unfavorable combination of poor knowledge of the speed and of erroneous assumptions as to the direction of rotation lead to a lack of precision in the estimating of the angular position at the time of the restart, which lack of precision lasts for at least three teeth/square waveforms.

An important observation of the invention is that the problem does not occur at all, or at the very least has a markedly lesser impact on the estimate of the angular position, when the last square waveform received before the stopping of the engine is a forwards-running square waveform. This is illustrated in FIG. 8.

Figure 8:
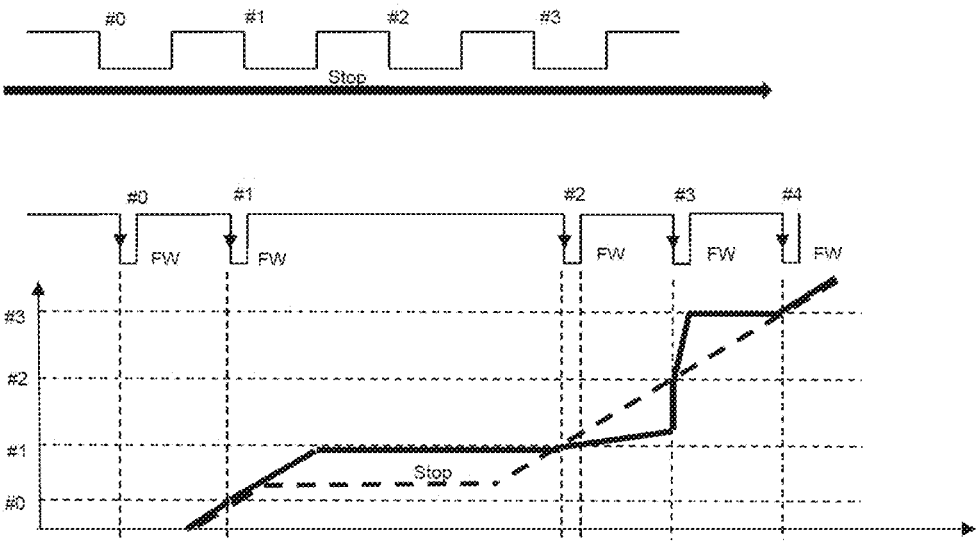
FIG. 8 illustrates how the processing device behaves in the event that a forwards-running square waveform is received before a stopping of the engine, on an absolute diagram.

As illustrated in FIG. 8, the engine stops between position #1 and position #2. As a result of the extrapolation, the estimated angular position continues until it becomes equal to #1, where it remains blocked. At the restart, the next square waveform #2 is correctly considered to be the square waveform #2 because the processing device still thinks that the engine is running forwards. A shallow gradient extrapolation is applied, as a precautionary measure, following the stopping of the engine. As a result, the estimate is pessimistic. On receipt of the next square waveform, this is correctly interpreted as being #3. The estimated angular position is immediately corrected by a rapid readjustment. Following square waveform #3, the extrapolation is too optimistic, because of the overcompensation associated with the steep gradient observed in the previous square waveform. At the next square waveform #4, the speed is now known with satisfactory precision and the extrapolation may be correct, as the two coincident curves testify.

So, according to a novel idea of the invention, an operation is performed that is neutral so far as the angular position is concerned, but which places the system, and particularly the processing device 5, back in the favorable scenario in which the last square waveform received is a forwards-running square waveform.

To do that, the invention simulates and transmits to the processing device 5 a succession of a backwards-running square waveform, 8, and of a forwards-running square waveform, 9. This can be seen in FIG. 9.

The invention relates to a method for processing signals from a crankshaft sensor, comprising the following steps: The method is initiated by a detection that the engine has stopped. Such a detection is generally obtained when no square waveform has come from the crankshaft sensor 1 for a certain period of time, preferably 250 ms. According to one feature, this detection may be confirmed, for example by a subsequent recheck, after a longer interval of time, in order to avoid any false detection.

According to an important feature of the invention, there is then a first step of simulating and transmitting a backwards-running square waveform, 8, followed by a second step of simulating and transmitting a forwards-running square waveform, 9. In this way, the processing module 6 simulates two successive square waveforms 8, 9, such as the crankshaft sensor 1 could have sent. These simulated square waveforms 8, 9 are transmitted to the processing device 5 as if they had come from the crankshaft sensor 1. Thus, according to the invention, the processing module 6 fools the processing device 5 by transmitting two extra square waveforms to it, in place of the crankshaft sensor 1.

Figure 5:
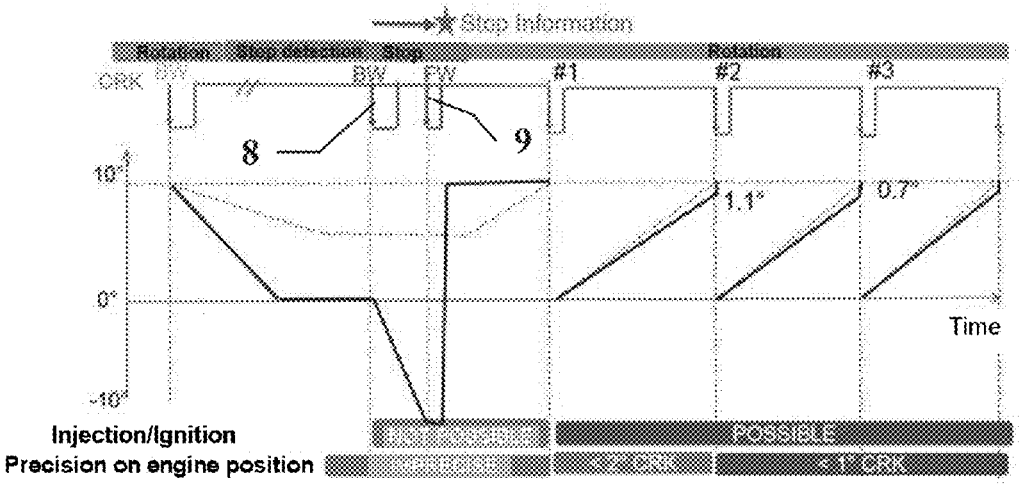
FIG. 5 shows, on a diagram featuring the angular position in offset as a function of time, against a signal CRK, and illustrates the result of the invention, which makes it possible to ensure that the last square waveform received at the time of a stopping of the engine is always a forwards-running square waveform, and the associated advantages at the time of the restart.

What then follows is that which can be described with reference to FIG. 5. The first row features the signal CRK from the crankshaft sensor 1. Underneath, and temporally aligned therewith, is a diagram indicating the angular position of the crankshaft, with the true position as a dotted line and the position as estimated by the processing device 5 as a solid line. The first square waveform on the left is the last square waveform received by the processing device 5 before the stopping of the engine. This is a backwards-running square waveform. The stopping of the engine occurs thereafter, and is featured by a double oblique stroke. After correction by the processing device 5, the estimated angular position of the engine is established as 0°. As soon as the absence of a square waveform (a steady state at 0°) is observed, it is determined that the engine has stopped and the method can begin. The processing module 6 simulates a backwards-running first square waveform 8 and a forwards-running second square waveform 9. These simulated square waveforms 8, 9 are transmitted to the processing device 5 as if they had come from the crankshaft sensor 1.

On receipt of the backwards-running first square waveform 8, the processing device 5 decrements the angular position by one angular increment corresponding to one tooth. On receipt of the forwards-running second square waveform 9, the processing device 5 increments the angular position by one angular increment corresponding to one tooth. The angular position is once again 0'. The receipt of the two square waveforms 8, 9 is thus an operation that is neutral insofar as it does not alter the resultant angular position. However, at the next engine restart, the last square waveform seen by the processing device 5 is now a forwards-running square waveform.

Figure 1:
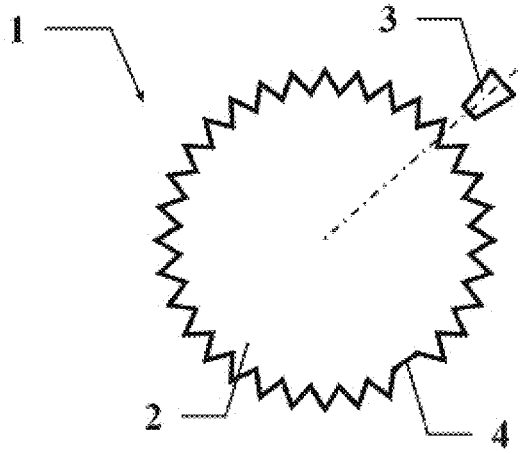
FIG. 1, which has already been described, illustrates the principle of a crankshaft sensor, FIG. 2, which has already been described, illustrates the mechanism for extrapolation and readjustment on receipt of a square waveform, FIG. 3, which has already been described, illustrates how the processing device behaves in the event that a backwards-running square waveform is received before a stopping of the engine, on an absolute diagram, FIG. 4, which has already been described, illustrates the same scenario as FIG. 3, on an offset diagram.
Figure 2:
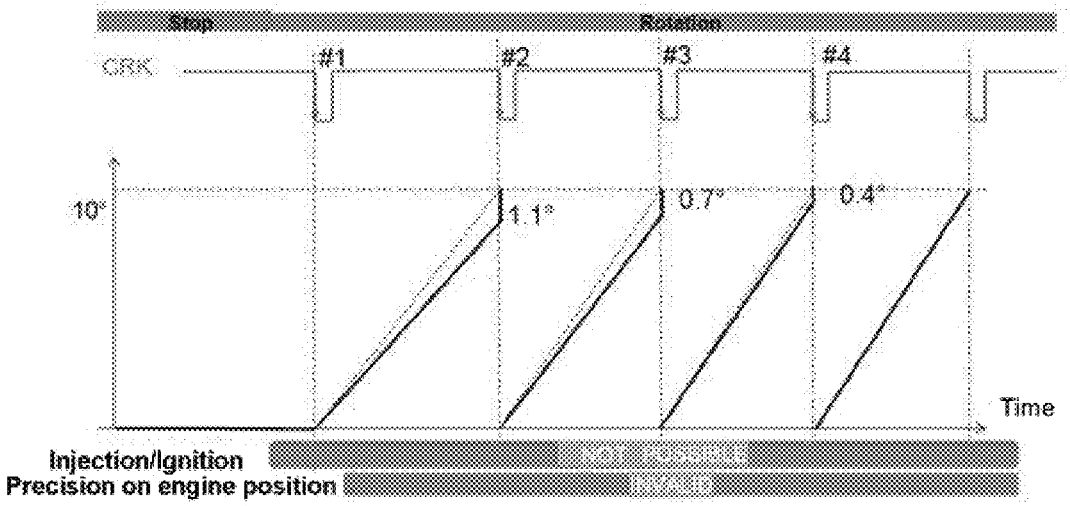
Figure 3:
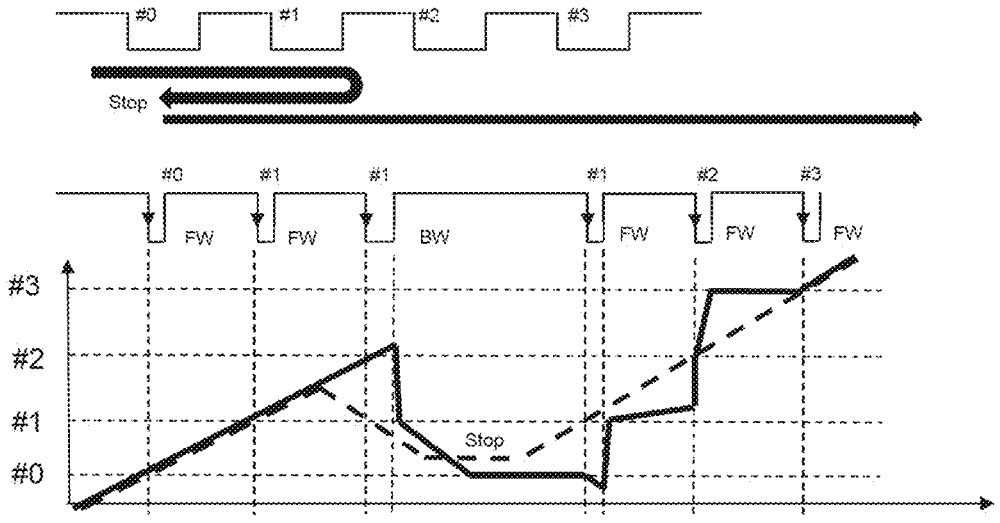
Figure 4:
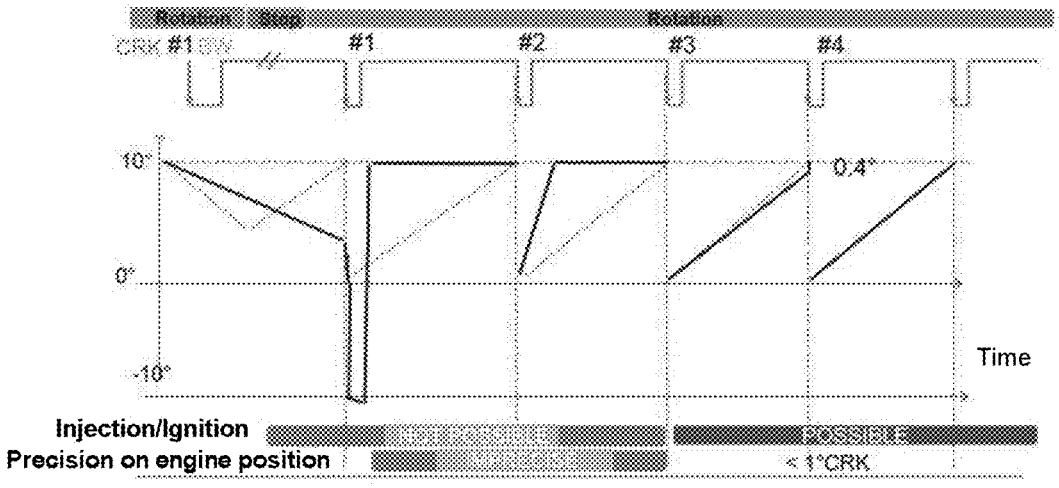

This feature completely changes the determination of the angular position at the following engine restart, as can be appreciated by comparison with the description given in relation to FIG. 4 in particular.

After receiving the forwards-running second square waveform 9, the processing device 5 interpolates the angular position optimistically. The angular position rapidly becomes offset by one tooth. It remains confined to not exceeding this value until the square waveform #1, which is the first real square waveform, is received. On receipt of the square waveform #1, the offset is reset to zero. At that moment, two square waveforms, the second simulated square waveform 9 and the square waveform #1, can be used to determine an estimate of the speed by relating the angular length of a tooth to the time separating said two square waveforms 9 and #1. Failing that, by not retaining the second simulated square waveform 9, it is possible to consider a default mean speed, for example of 60 rpm. Because these two square waveforms are in the same direction, forwards, the extrapolation between the square waveforms #1 and #2 is, however, far more precise than the critical scenario. It can be seen from the figure that the error readjusted for on arriving at square waveform #2 is just 1.1°. Such an error is small enough to allow the engine control operations such as injection and/or ignition to be performed.

Then, between the square waveforms #2 and #3 and then between the square waveforms #3 and #4, as the number of square waveforms increases, the precision of the calculation of the angular speed increases and the extrapolation of the angular position becomes all the more precise.

The invention thus makes it possible to obtain enough precision on the angular position that injection and/or ignition can take place, and is advantageously able to do so as soon as the first real square waveform #1 is received, whereas the prior art entailed waiting for the 4th square waveform #4.

It may advantageously be noted that the addition of two simulated square waveforms 8, 9 has no side effect on diagnostics or on safety. Due to the fact that these two square waveforms are of opposing direction, they cancel one another as far as the checks on the plausibility of the signal CRK from the crankshaft sensor 1 are concerned. In addition, the engine has physically stopped at the time at which these two simulated square waveforms 8, 9 are introduced. Thus, there is no risk of confusion with receipt of a square waveform resulting from the detection of an actual tooth. No diagnostics react to just two wave edges while an engine is stopped. No poor angular speed (engine speed) is exported.

Figure 9:
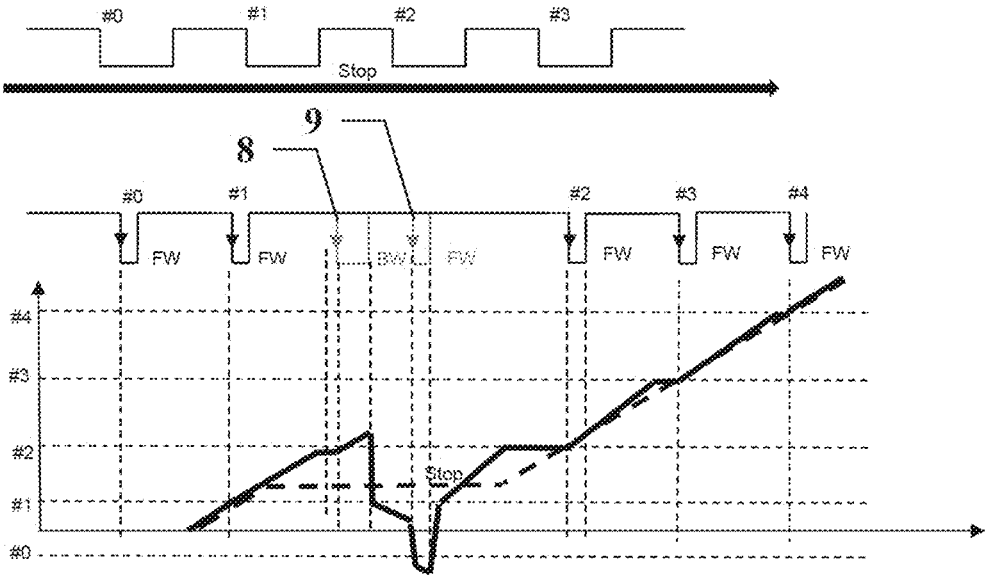
FIG. 9 illustrates how the processing device behaves in the event that a forwards-running square waveform is received before a stopping of the engine, and shows the effect of the invention and the associated advantages at the time of the restart.

As illustrated in FIG. 9, from left to right, at the square waveform #1, the speed is known. Extrapolation is good with an estimate that coincides with the true angular position. The engine stops shortly after the square waveform #1. Extrapolation continues until position #2 is reached, which cannot be exceeded until a new square waveform is received. The falling wave edge of the first simulated square waveform 8 is then received. The processing device 5, still persuaded that the engine is running forwards, begins by incrementing the angular position. On receiving the rising wave edge of the first simulated square waveform 8, the processing device 5 realises that this is a backwards-running (BW) square waveform, and immediately corrects the angular position to position #1. The extrapolation continues, now in the backwards direction of running, with a gradient that is shallow on account of the change in direction. The falling wave edge of the second simulated square waveform 9 is then received. The processing device 5, persuaded that the engine is running backwards, begins by decrementing the angular position. On receiving the rising wave edge of the second simulated square waveform 9, it realises that this is a forwards-running (FW) square waveform, and immediately corrects the angular position to position #1. The extrapolation continues to increment, now in the forwards direction of running, with a gradient that is shallow on account of the stopping of the engine. However, this is too optimistic and the estimate reaches the position #2 before the corresponding square waveform #2 has been received. The estimate therefore awaits receipt of the square waveform #2. From #2 to #3, the extrapolation uses a first constant mean speed, for example 60 rpm, which turns out to be slightly optimistic. From #3 to #4, the extrapolation uses a second constant mean speed, for example 90 rpm, which turns out to be very slightly optimistic. After #4, the speed, after three square waveforms #1, #2, #3, is now known with precision and the extrapolation can use this speed: the two curves are coincident.

According to one feature, the addition of the two simulated square waveforms according to the invention can be applied systematically as soon as a stopping of the engine is detected. Advantageously, said addition can be applied only when necessary, namely only when the last square waveform received before the stopping of the engine corresponds to a backwards rotation of the engine.

According to the prior art, when a stopping of the engine is detected, an "engine stopped" status signal is transmitted to certain modules which require and use this information.

This "engine stopped" status information is used for example by a starter controller which needs to ensure that the engine is stopped before allowing a restart. This is because activating the engine starter while the engine is running may damage the starter.

According to the prior art, this transmission is performed as soon as the "engine stopped" status signal is produced. According to another advantageous feature of the invention, the transmission of the "engine stopped" status signal is, rather, suspended for at least the time taken for the two simulated square waveforms 8, 9 to be transmitted. Thus, even if the "engine stopped" status signal has been produced and available right from the start of the method, the transmission thereof is suspended. This suspension of the transmission is advantageously lifted after the two simulated square waveforms 8, 9 have been transmitted, so that said "engine stopped" status signal is transmitted to the module(s) concerned with processing it.

In order not to waste time, the transmission of the simulated square waveforms 8, 9 needs to be performed rapidly so as not to interfere with a possible restart.

According to another feature, the transmission of the backwards-running square waveform 8 is performed as quickly as possible, immediately following the detection that the engine has stopped.

The same may be true of the transmission of the forwards-running square waveform 9. However, a noise filtering strategy may be implemented on the input side of the processing device 5. Such a strategy could eliminate a second square waveform 9 appearing too soon after the first square waveform 8. Thus, according to another feature, the transmission of the second square waveform 9 is advantageously delayed after transmission of the backwards-running square waveform 8. The delay applied in this case is just enough to render the noise filtering strategy inoperative. This delay is preferably equal to 1 ms.

Figure 6:
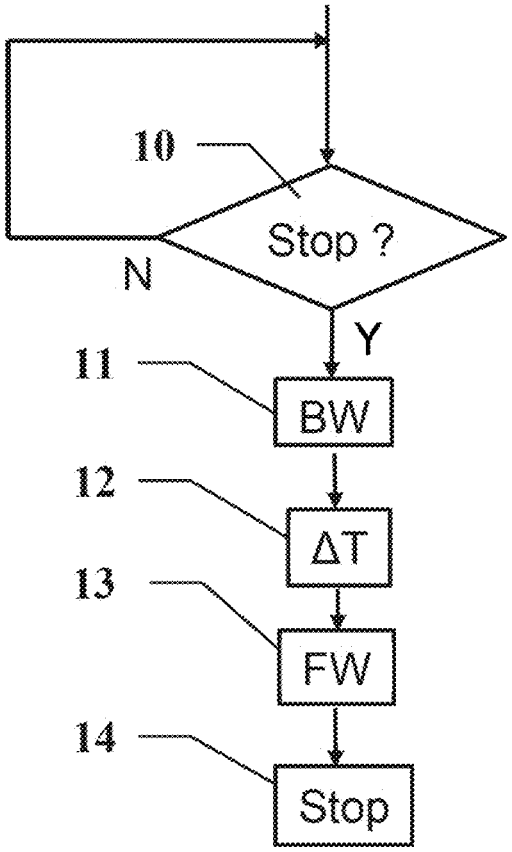
FIG. 6 illustrates the sequence of the steps of the method.

As illustrated in FIG. 6, the method begins by waiting 10 for the engine to stop. When such an engine stop (Stop) is detected, a backwards-running square waveform 8 is simulated (BW) and transmitted 11. A delay 12 is then applied ($\Delta T$) if appropriate, in order to avoid unwanted filtering. A forwards-running square waveform 9 is then simulated (FW) and transmitted 13. Thereafter, the "engine stopped" status signal (Stop), which had been delayed, can then be transmitted 14.

In order not to interfere with the calculation of the speed, the simulated square waveforms 8, 9, which do not correlate with an actual movement of the crankshaft wheel 2, can be disregarded in the speed calculation. According to one feature, the first simulated square waveform 8 is ignored in calculating the speed. According to one feature, the first simulated square waveform 8 and the second simulated square waveform 9 are ignored in calculating the speed.

The two simulated square waveforms 8, 9 do not in any way interfere with the engine control functions because the engine has not yet been declared to have stopped. The engine may still possibly hiccup.

Conventionally according to the prior art, the speed is calculated with precision using a three-term recurrence formula, using the last three square waveforms. So, in a restart, it is necessary to find another approach while three square waveforms, be they real square waveforms or simulated square waveforms, have not yet been received.

According to another feature of the invention, the speed is considered to be equal to a first constant mean value when only one square waveform has been received. This constant mean value is preferably equal to 60 rpm, which constitutes an approximation of the speed of an engine on starting.

According to another feature of the invention, the speed is considered to be equal to a second constant mean value when only two square waveforms have been received. This constant mean value is preferably equal to 90 rpm.

The two values of 60 and 90 rpm are indicative. They correspond to values observed on a given engine with a standard nominal battery voltage.

According to another feature, the speed is calculated on the time between two square waveforms when only two square waveforms have been received.

Thereafter, as soon as at least three square waveforms have been received, the formula of the prior art may advantageously be employed.

The invention also relates to a processing module 6 configured to implement the method described hereinabove.

The invention has been described above by way of example. It will be understood that a person skilled in the art is able to produce different variant embodiments of the invention, for example by combining the various features above taken alone or in combination, without departing from the scope of the invention in doing so.

The invention claimed is:

1. A method whereby a processing module (6) processes signals from a crankshaft sensor (1) in order to determine the position of an internal combustion engine upon a starting of said engine following a stopping thereof, said crankshaft sensor comprising a crankshaft wheel (2) comprising a determined number of teeth and at least one index (4) allowing a position in the revolution to be identified, said sensor being able, in combination with a processing device (5) for processing said signals, to determine the position of the crankshaft and direction of rotation of the crankshaft, from said signals comprising forwards-running and backwards-running square waveforms, the method comprising:

detection of a stopping of said internal combustion engine, and, if the last square waveform received by the processing device (5) before the stopping of the engine corresponds to the engine rotating backwards:

suspension of the transmission to the processing device (5) of an "engine stopped" status signal, and then simulation by the processing module (6) and transmission to the processing device (5) of a backwards-running square waveform (8), simulation by the processing module (6) and transmission to the processing device (5) of a forwards-running square waveform (9), leading to a detection by the processing device (5) that the crankshaft is running forwards, and, following the transmission of the two simulated square waveforms (8, 9) to the processing device (5), the lifting of said suspension and the transmission of the "engine stopped" status signal to the processing device (5).

2. The method as claimed in claim 1, wherein the transmission of the backwards-running square waveform (8) immediately follows the detection that the engine has stopped.

3. The method as claimed in claim 2, wherein the transmission of the forwards-running square waveform (9) is delayed after transmission of the backwards-running square waveform (8) by enough of a delay to render a noise filtering strategy inoperative.

4. The method as claimed in claim 2, wherein the speed is considered to be equal to a first constant mean value when only a single square waveform has been received, and/or the speed is calculated on the basis of the time between two square waveforms, or is considered to be equal to a second constant mean value when only two square waveforms have been received.

5. The method as claimed in claim 1, wherein the transmission of the forwards-running square waveform (9) is delayed after transmission of the backwards-running square waveform (8) by enough of a delay to render a noise filtering strategy inoperative.

6. The method of claim 5, wherein the delay is equal to 1 ms.

7. The method as claimed in claim 5, wherein the speed is considered to be equal to a first constant mean value when only a single square waveform has been received, and/or the speed is calculated on the basis of the time between two square waveforms, or is considered to be equal to a second constant mean value when only two square waveforms have been received.

8. The method as claimed in claim 1, wherein a calculation of the engine speed ignores the simulated backwards-running square waveform (8).

9. The method as claimed in claim 8, wherein the speed is considered to be equal to a first constant mean value when only a single square waveform has been received, and/or the speed is calculated on the basis of the time between two square waveforms, or is considered to be equal to a second constant mean value when only two square waveforms have been received.

10. The method as claimed in claim 1, wherein a calculation of the engine speed ignores the simulated backwards-running square waveform (8) and the simulated forwards-running square waveform (9).

11. The method as claimed in claim 10, wherein the speed is considered to be equal to a first constant mean value when only a single square waveform has been received, and/or the speed is calculated on the basis of the time between two square waveforms, or is considered to be equal to a second constant mean value when only two square waveforms have been received.

12. The method as claimed in claim 1, wherein the speed is considered to be equal to a first constant mean value, when only a single square waveform has been received, and/or the speed is calculated on the basis of the time between two square waveforms, or is considered to be equal to a second constant mean value when only two square waveforms have been received.

13. The method of claim 12, wherein the first constant mean value is 60 rpm.

14. The method of claim 13, wherein the second constant mean value is 90 rpm.

15. A processing module (6) for processing signals from a crankshaft sensor (1), the processing module being configured to implement the method as claimed in claim 2.

16. A processing module (6) for processing signals from a crankshaft sensor (1), the processing module being configured to implement the method as claimed in claim 5.

17. A processing module (6) for processing signals from a crankshaft sensor (1), the processing module being configured to implement the method as claimed in claim 8.

18. A processing module (6) for processing signals from a crankshaft sensor (1), the processing module being configured to implement the method as claimed in claim 10.

19. A processing module (6) for processing signals from a crankshaft sensor (1), the processing module being configured to implement the method as claimed in claim 12.

20. A processing module (6) for processing signals from a crankshaft sensor (1), the processing module being configured to implement the method as claimed claim 1.

* * * * *